US011918042B2

(12) United States Patent
White

(10) Patent No.: US 11,918,042 B2
(45) Date of Patent: Mar. 5, 2024

(54) COMBINED STORAGE CONTAINER AND PIPE APPARATUS

(71) Applicant: Reginald White, Tukwila, WA (US)

(72) Inventor: Reginald White, Tukwila, WA (US)

( * ) Notice: Subject to any disclaimer, the term of this patent is extended or adjusted under 35 U.S.C. 154(b) by 1002 days.

(21) Appl. No.: 16/828,147

(22) Filed: Mar. 24, 2020

(65) Prior Publication Data

US 2021/0298354 A1 Sep. 30, 2021

(51) Int. Cl.
*A24F 3/00* (2006.01)
*A24F 23/00* (2006.01)
*A24F 1/32* (2006.01)

(52) U.S. Cl.
CPC ..... *A24F 3/00* (2013.01); *A24F 1/32* (2013.01); *A24F 23/00* (2013.01)

(58) Field of Classification Search
None
See application file for complete search history.

(56) References Cited

U.S. PATENT DOCUMENTS 2,453,971 A 11/1948 Chemlinski
D243,774 S 3/1977 Molinaro
4,216,786 A 8/1980 Wright
4,484,590 A 11/1984 Singh
5,832,935 A 11/1998 Heine
9,635,883 B1 5/2017 Guardian
2020/0315246 A1* 10/2020 LeNoir et al. ..... A24F 1/30

FOREIGN PATENT DOCUMENTS

WO WO2005046367 5/2005
WO WO 2020/043224 * 3/2020 ..... A24F 1/30

OTHER PUBLICATIONS

Merriam-Webster.com—"Bowl" definition entry, https://www.merriam-webster.com/dictionary/bowl, printed from the Internet on May 25, 2023. (Year: 2023).*

* cited by examiner

*Primary Examiner* — Dionne W. Mayes

(57) ABSTRACT

A combined storage container and pipe apparatus for convenient storage and smoking of a smokable substance includes a tube and a lid. The tube defines an interior space and has a top that is open. The top allows reversible addition of a smokable substance into the interior space. The tube has an indentation positioned in a sidewall thereof proximate to a bottom thereof. A portion of the smokable substance can be positioned in the indentation. The indentation has an aperture centrally positioned therein. The lid is selectively engageable to the tube to close the top and has a hole positioned therethrough around which a user can position their lips. The user is positioned to light the portion of the smokable substance that is positioned in the indentation and to draw smoke through the aperture and the interior space into at least one of a mouth and lungs of the user.

13 Claims, 5 Drawing Sheets

COMBINED STORAGE CONTAINER AND PIPE APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to pipe apparatuses and more particularly pertains to a new pipe apparatus for convenient storage and smoking of a smokable substance.

(2) Description of Related Art Including Information Disclosed Under 37 CFR 1.97 and 1.98

The prior art relates to pipe apparatuses. Prior art pipe apparatuses including a storage compartment generally comprises a distinct storage compartment, a burning chamber, and a separated airway through which smoke passes

BRIEF SUMMARY OF THE INVENTION

An embodiment of the disclosure meets the needs presented above by generally comprising a tube and a lid. The tube defines an interior space and has a top that is open. The top is configured for reversible addition of a smokable substance into the interior space, such as tobacco, cannabis (with and without THC), marjoram, clove, Indian-tobacco, and many other smokable plants. The tube has an indentation positioned in a sidewall thereof proximate to a bottom thereof. The indentation is configured to position a portion of the smokable substance. The indentation has an aperture centrally positioned therein.

The lid is selectively engageable to the tube to close the top. The lid has a hole positioned therethrough and configured to be surrounded by lips of a user. The user is positioned to light the portion of the smokable substance that is positioned in the indentation and to draw smoke through the aperture and the interior space into at least one of a mouth and lungs of the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
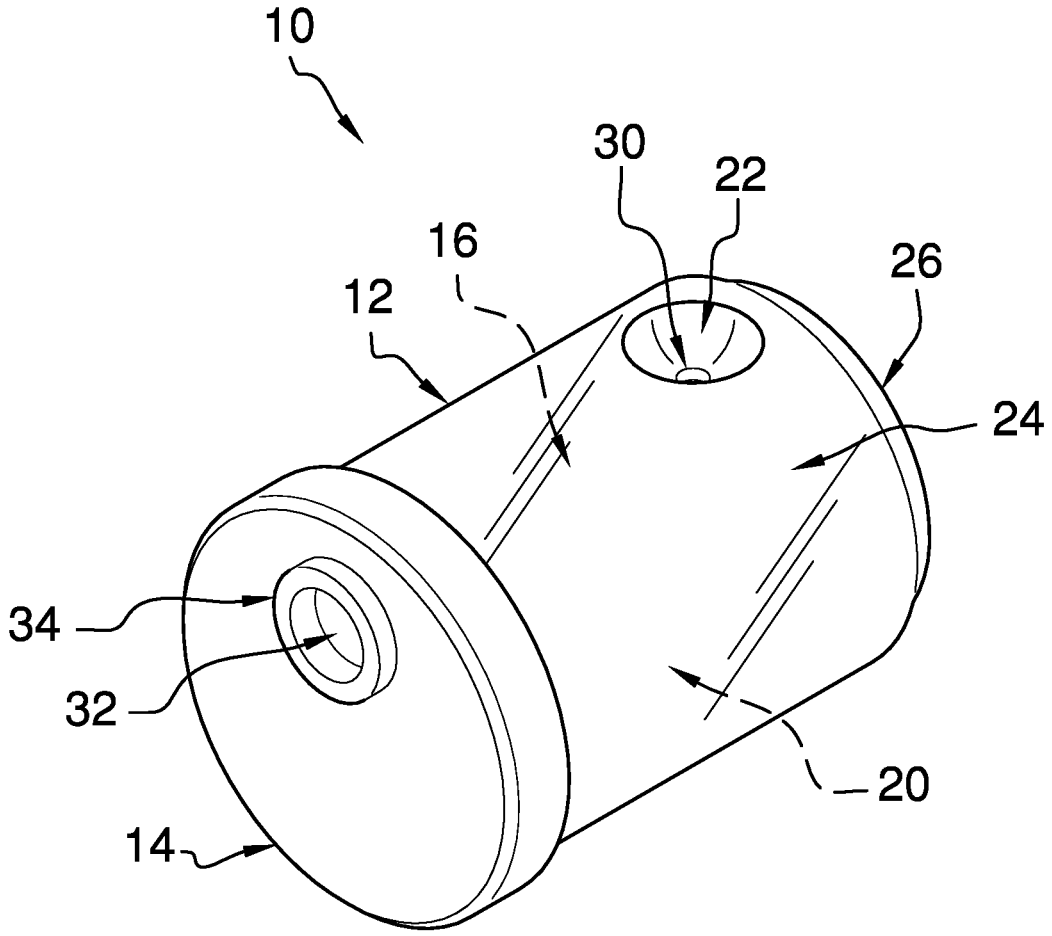
FIG. 1 is an isometric perspective view of a combined storage container and pipe apparatus according to an embodiment of the disclosure.
Figure 2:
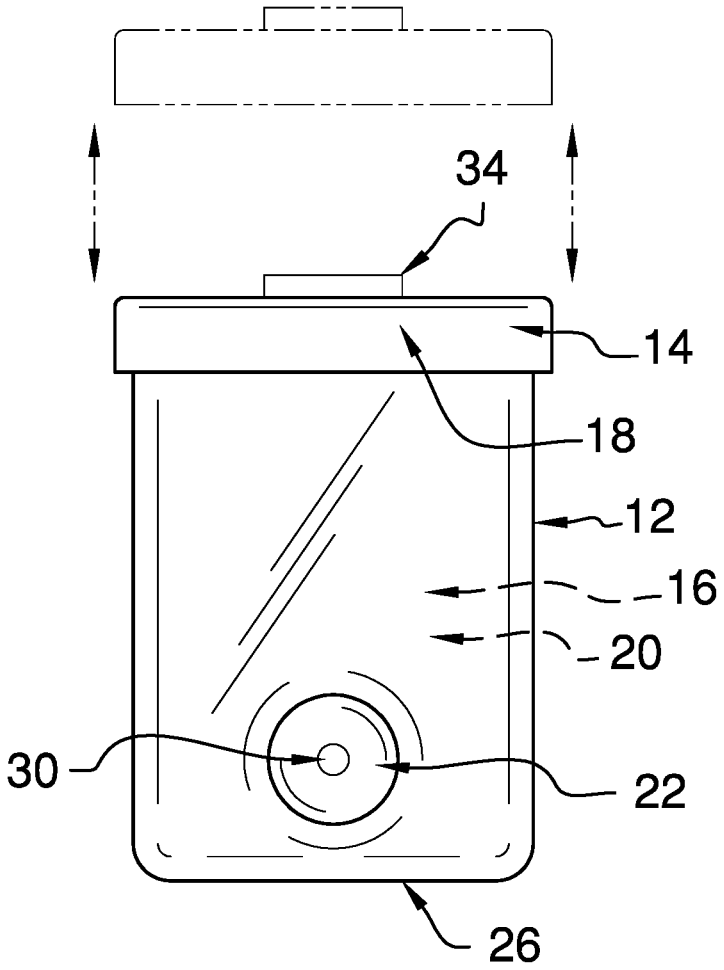
FIG. 2 is a side view of an embodiment of the disclosure.

With reference now to the drawings, and in particular to FIGS. 1 through 6 thereof, a new pipe apparatus embodying the principles and concepts of an embodiment of the disclosure and generally designated by the reference numeral 10 will be described.

As best illustrated in FIGS. 1 through 6, the combined storage container and pipe apparatus 10 generally comprises a tube 12 and a lid 14. The tube 12 defines an interior space 16 and has a top 18 that is open. The top 18 is configured for reversible addition of a smokable substance 20 into the interior space 16, such as tobacco, cannabis (with and without THC), marjoram, clove, Indian-tobacco, and many other smokable plants. The tube 12 may be cylindrical, as shown in FIG. 1, but also may be alternatively shaped, such as, but not limited to, rectangularly box shaped, truncated cone shaped, and the like. The tube 12 may comprise glass, or other material compatible with burning of a smokable substance 20, such as, but not limited to, metal, ceramic, and the like.

Figure 4:
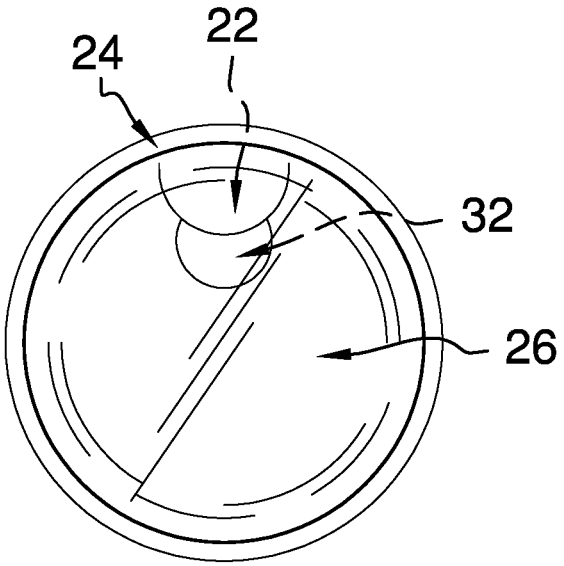
FIG. 4 is a bottom view of an embodiment of the disclosure.
Figure 5:
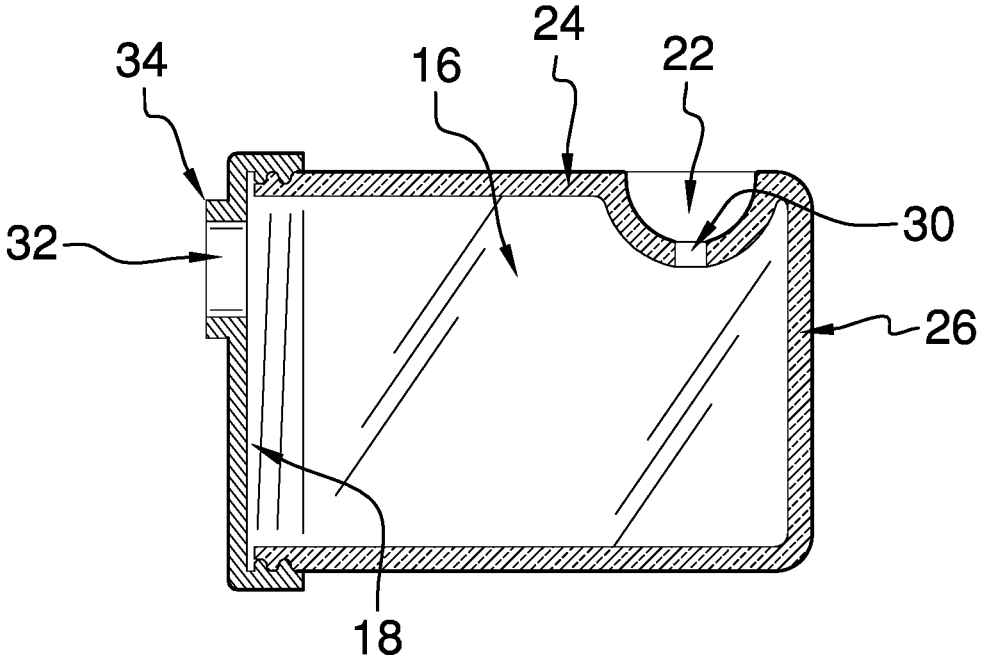
FIG. 5 is a cross-sectional view of an embodiment of the disclosure.
Figure 6:
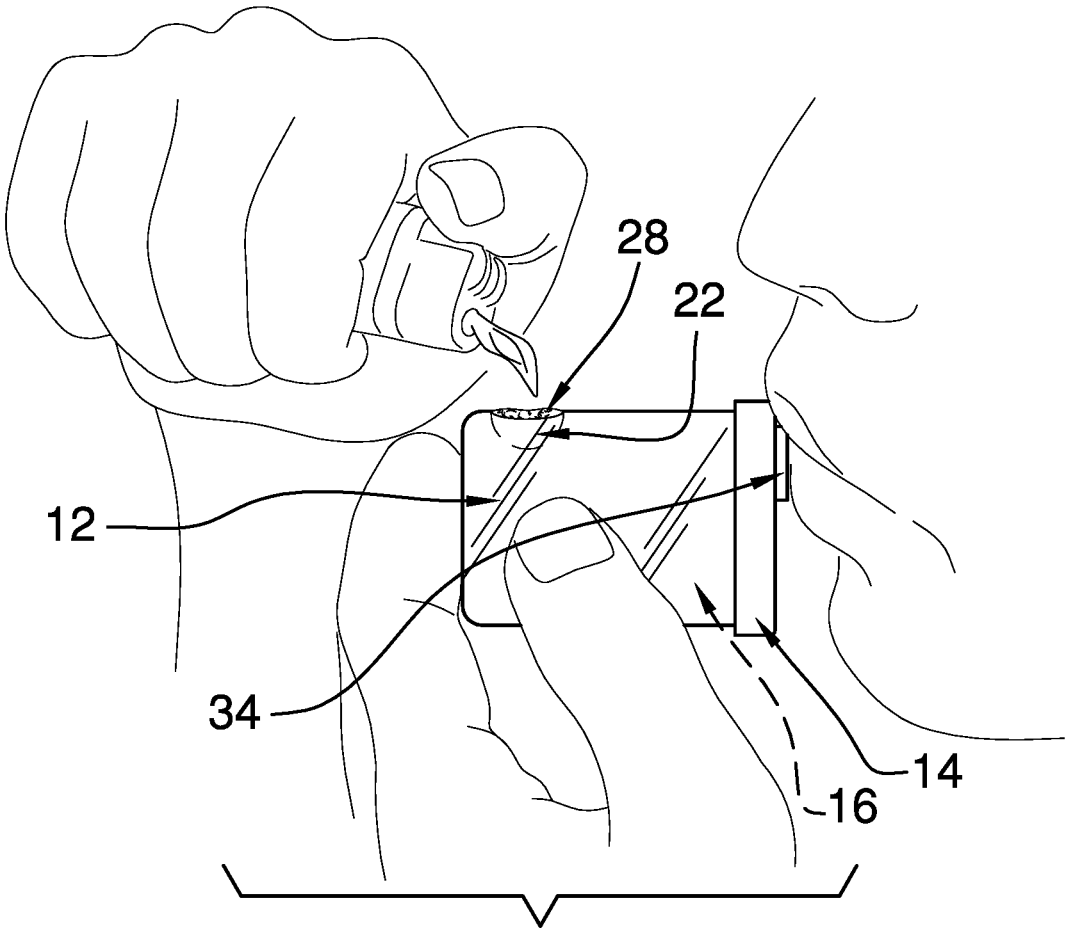
FIG. 6 is an in-use view of an embodiment of the disclosure.

The tube 12 has an indentation 22 positioned in a sidewall 24 thereof proximate to a bottom 26 thereof. The indentation 22 is configured to position a portion 28 of the smokable substance 20. The indentation 22 may be semispherical, as shown in FIGS. 4 and 5, but also may be alternatively shaped, such as, but not limited to, rectangularly box shaped, truncated cone shaped, and the like. The indentation 22 has an aperture 30 centrally positioned therein. As will become apparent, the aperture 30 allows smoke generated within the indentation 22 to be drawn into the interior space 16. The present invention also anticipates the aperture 30 comprising a plurality of apertures 30 such that the indentation 22 is screen like.

Figure 3:
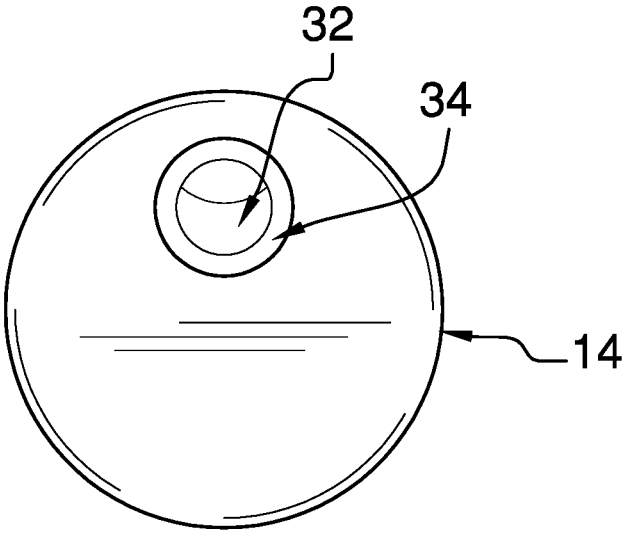
FIG. 3 is a top view of an embodiment of the disclosure.

The lid 14 is selectively engageable to the tube 12 to close the top 18. The lid 14 has a hole 32 positioned therethrough, which is configured to be surrounded by lips of a user. The hole 32 may be circular, as shown in FIG. 3, but also may be alternatively shaped, such as, but not limited to, ovally shaped, square shaped, and the like. The user is positioned to light the portion 28 of the smokable substance 20 that is positioned in the indentation 22 and to draw smoke through the aperture 30 and the interior space 16 into at least one of a mouth and lungs of the user. A rim 34 is coupled to the lid 14 and extends circumferentially around the hole 32. The rim 34 is configured to facilitate sealable coupling of the lips of the user around the hole 32.

The tube 12 may externally threaded proximate to the top 18 and the lid 14 may be internally threaded. The lid 14 thus is positioned to be selectively threadedly engaged to the tube 12 to removably engage the lid 14 to the tube 12. The present invention anticipates the lid 14 be removably engageable to the tube 12 by other engaging means, such as, but not limited to, frictional coupling, clampable lids, and the like.

The present device also anticipates removable coverings (not shown) for the hole 32 and the indentation 22 to preserve freshness of smokable substance 20 positioned in the interior space 16 of the tube 12.

In one example of use, a user might acquire a tube 12 containing one or more portions 28 of a smokable substance 20. A portion 28 of the smokable substance 20 is extracted from the interior space 16 and positioned in the indentation 22. The user then positions their lips around the rim 34, lights the smokable substance 20, and draws the smoke through the aperture 30 and the interior space 16 into at least one of a mouth and lungs of the user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A combined storage container and pipe apparatus comprising:

a tube defining an interior space, the tube having a top, the top being open wherein the top is configured for insertion of a smokable substance into the interior space for storage of the smokable substance, the tube having an indentation positioned in a sidewall thereof proximate to a bottom thereof such that the indentation integrally defines a bowl in the sidewall, wherein the indentation is configured for positioning a portion of the smokable substance in the bowl defined by the indentation, the indentation having an aperture centrally positioned therein, wherein the indentation is semispherical; and a lid selectively engageable to the tube for closing the top, the lid having a hole positioned therethrough, wherein the hole is configured for surrounding by lips of a user, positioning the user for lighting the portion of the smokable substance positioned in the indentation and for drawing smoke through the aperture and the interior space into at least one of a mouth and lungs of the user.

2. The combined storage container and pipe apparatus of claim 1, wherein the tube is cylindrical.

3. The combined storage container and pipe apparatus of claim 2, wherein:

the tube is externally threaded proximate to the top, and;

the lid is internally threaded such that the lid is positioned for selectively threadedly engaging the tube for removably engaging the lid to the tube.

4. The combined storage container and pipe apparatus of claim 1, wherein the tube comprises glass.

5. The combined storage container and pipe apparatus of claim 1, wherein the hole is circular.

6. The combined storage container and pipe apparatus of claim 1, further including a rim coupled to the lid and extending circumferentially around the hole, wherein the rim is configured for sealably coupling to the lips of the user.

7. A combined storage container and pipe apparatus and smokable substance combination comprising:

a smokable substance;

a tube defining an interior space, the tube having a top, the top being open wherein the top is configured for insertion of a smokable substance into the interior space for storage of the smokable substance, the tube having an indentation positioned in a sidewall thereof proximate to a bottom thereof such that the indentation integrally defines a bowl in the sidewall, such that a portion of the smokable substance is selectively removable from the interior space for positioning in the bowl defined by the indentation, the indentation having an aperture centrally positioned therein, wherein the indentation is semispherical; and a lid selectively engageable to the tube for closing the top, the lid having a hole positioned therethrough, wherein the hole is configured for surrounding by lips of a user, positioning the user for lighting the portion of the smokable substance positioned in the indentation and for drawing smoke through the aperture and the interior space into at least one of a mouth and lungs of the user.

8. The combined storage container and pipe apparatus and smokable substance combination of claim 7, wherein the tube is cylindrical.

9. The combined storage container and pipe apparatus and smokable substance combination of claim 8, wherein:

the tube is externally threaded proximate to the top, and;

the lid is internally threaded such that the lid is positioned for selectively threadedly engaging the tube for removably engaging the lid to the tube.

10. The combined storage container and pipe apparatus and smokable substance combination of claim 7, wherein the tube comprises glass.

11. The combined storage container and pipe apparatus and smokable substance combination of claim 7, wherein the hole is circular.

12. The combined storage container and pipe apparatus and smokable substance combination of claim 7, further including a rim coupled to the lid and extending circumferentially around the hole, wherein the rim is configured for sealably coupling to the lips of the user.

13. A combined storage container and pipe apparatus comprising:

a tube defining an interior space, the tube having a top, the top being open wherein the top is configured for insertion of a smokable substance into the interior space for storage of the smokable substance, the tube having an indentation positioned in a sidewall thereof proximate to a bottom thereof such that the indentation integrally defines a bowl in the sidewall, wherein the indentation is configured for positioning a portion of the smokable substance in the bowl defined by the indentation, the indentation having an aperture centrally positioned therein, the tube being cylindrical, the indentation being semispherical, the tube comprising glass, the tube being externally threaded proximate to the top;

a lid selectively engageable to the tube for closing the top, the lid having a hole positioned therethrough, wherein the hole is configured for surrounding by lips of a user, positioning the user for lighting the portion of the smokable substance positioned in the indentation and for drawing smoke through the aperture and the interior space into at least one of a mouth and lungs of the user, the hole being circular, the lid being internally threaded such that the lid is positioned for selectively threadedly engaging the tube for removably engaging the lid to the tube; and a rim coupled to the lid and extending circumferentially around the hole, wherein the rim is configured for sealably coupling to the lips of the user.

* * * * *